US009989332B1

(12) United States Patent
Zhang et al.

(10) Patent No.: US 9,989,332 B1
(45) Date of Patent: Jun. 5, 2018

(54) SHOOTING ANGLE FITTING METHOD FOR INTEGRATED PRECISION PHOTOELECTRIC SIGHTING SYSTEM

(71) Applicant: Huntercraft Limited, Albany, NY (US)

(72) Inventors: Lin Zhang, Albany, NY (US); Chunhua Shi, Albany, NY (US); Sang Su, Albany, NY (US)

(73) Assignee: Huntercraft Limited, Albany, NY (US)

( * ) Notice: Subject to any disclaimer, the term of this patent is extended or adjusted under 35 U.S.C. 154(b) by 0 days. days.

(21) Appl. No.: 15/353,152

(22) Filed: Nov. 16, 2016

(51) Int. Cl.

| | |
|---|---|
| ***G06F 19/00*** | (2018.01) |
| ***F41G 3/08*** | (2006.01) |
| ***F41G 1/38*** | (2006.01) |
| ***F41G 3/06*** | (2006.01) |

(52) U.S. Cl.
CPC ..... *F41G 3/08* (2013.01); *F41G 1/38* (2013.01); *F41G 3/06* (2013.01)

(58) Field of Classification Search
CPC ..... F41G 3/08; F41G 1/38; F41G 3/06
USPC ..... 235/404, 407, 410, 416, 417
See application file for complete search history.

(56) References Cited

U.S. PATENT DOCUMENTS

| | | | | |
|---|---|---|---|---|
| 9,689,644 | B1 * | 6/2017 | Zhang | F41G 3/06 |
| 2016/0231083 | A1 * | 8/2016 | Regan | F41G 1/38 |

* cited by examiner

*Primary Examiner* — Karl D Frech
(74) *Attorney, Agent, or Firm* — Novick, Kim & Lee, PLLC; Allen Xue

(57) ABSTRACT

The invention belongs to the technical field of sighting mirrors, and specifically relates to a shooting angle fitting method for an integrated precision photoelectric sighting system. The invention puts forward a precision photoelectric sighting system, which is simple in shooting calibration and quick and accurate in sighting, adapts to any environmental factor, can furthest reduce the use of sensors and realizes double-eye sighting. The invention provides a shooting angle fitting method for an integrated precision photoelectric sighting system. The system comprises a view field acquisition unit, a display unit, a ranging unit and a sighting circuit unit; the sighting circuit unit is provided with a memory card, the memory card stores the shooting angle fitting method, and precise shooting under any environment is realized using the integrated precision photoelectric sighting system.

10 Claims, 7 Drawing Sheets

SHOOTING ANGLE FITTING METHOD FOR INTEGRATED PRECISION PHOTOELECTRIC SIGHTING SYSTEM

FIELD OF THE INVENTION

The present invention belongs to the technical field of sighting mirrors, and particularly relates to a shooting angle fitting method for an integrated precision photoelectric sighting system.

BACKGROUND OF THE INVENTION

Generally, traditional sighting devices are divided into mechanical sighting devices and optical sighting devices, wherein the mechanical sighting devices realize sighting mechanically via metal sighting tools, such as battle sights, sight beads and sights; and the optical sighting devices realize imaging with optical lenses to superpose a target image and a sighting line on the same focusing plane.

When the above two kinds of traditional sighting devices are applied to aimed shooting after the sighting tools are installed, accurate shooting can be accomplished by accurate sighting gesture and long-term shooting experience. However, for shooting beginners, inaccurate sighting gesture and scanty shooting experience may influence their shooting accuracy.

In the shooting process of the two kinds of traditional sighting devices, an impact point and a division center need to be calibrated multiple times to superpose; in the process of calibrating the impact point and the division center to superpose, a knob is adjusted multiple times or other mechanical adjustment is performed; and after the sighting device adjusted using the knob or adjusted mechanically is used frequently, the knob and other parts of the sighting device are worn, so that unquantifiable deviation is produced and the use of the sighting device is influenced.

When a large-sized complex photoelectric sighting system is applied to outdoor shooting, the photoelectric sighting system cannot accurately quantify environmental information due to such environmental factors as uneven ground, high obstacle influence, uncertain weather change and the like, and then cannot meet parameter information required by a complex trajectory equation, so diverse sensors are needed, such as a wind velocity and direction sensor, a temperature sensor, a humidity sensor and the like, and the large-sized complex photoelectric sighting system need to carry many sensor accessories and is difficult in ensuring the shooting accuracy in the absence of the sensors in the use environment.

At the moment, a simple model system having no need of various environmental factor parameters is needed to replace a trajectory model system requiring multiple environmental parameters. In the present invention, a shooting angle fitting method adapting to various environments without environmental parameters is studied out based on a sighting system of a gun itself in combination with physical science and ballistic science, to realize precision positioning of a photoelectric sighting system.

SUMMARY OF THE INVENTION

To address the problems in the prior art, the present invention provides a precision photoelectric sighting system, which is simple in shooting calibration and quick and accurate in sighting and can realize man-machine interaction, adapt to any environmental factor, furthest reduce the use of sensors and realize double-eye sighting.

The present invention provides a shooting angle fitting method for an integrated precision photoelectric sighting system, the sighting system can be conveniently installed on various firearms, the photoelectric sighting system includes a shell, the whole shell is of a detachable structure, the interior of the shell is an accommodating space, and the accommodating space accommodates a view field acquisition unit, a display unit, a power supply and a sighting circuit unit;

the shooting angle fitting method is applied to the photoelectric sighting system, can adapt to any environmental factor and furthest reduce the use of sensors, and realizes precision shooting with least calibration in consideration of a shooting pitching angle.

Further, the shooting angle fitting method comprises a deviation matching fitting algorithm based on a shooting angle and a compensation fitting algorithm based on a shooting angle.

Further, the deviation matching fitting algorithm based on a shooting angle comprises:

1) calculating the included angle $\alpha$ between the barrel axis of a gun used by a user and a sighting line;

2) calculating the included angle between the barrel axis of the gun used by the user and the optical axis of a sighting mirror under the shooting distance M;

3) calculating horizontal deviation and vertical deviation under the shooting distance S; and 4) calculating fitted deviation values according to the matching of the shooting distance and a database.

Further, in the deviation matching fitting algorithm:

the method of calculating the included angle $\alpha$ between the barrel axis of a gun used by a user and a sighting line in step 1) is as follows:

the flight trajectory can be decomposed into a horizontal distance and a vertical distance; according to the built-in gun sighting parameter table set in the factory and the model of the gun, the following parameters can be obtained: sight height H, sight bead height H', distance w1 between the sight and the sight bead, and distance w2 between the sight bead and the muzzle, and then $\alpha$ can be expressed as:

$$\tan \alpha=(H-H')/w1$$

the method of calculating the included angle $\beta$ between the barrel axis of the gun used by the user and the optical axis of a sighting mirror under the shooting distance M in step 2) is as follows:

$$\tan \beta=L/M$$

wherein, L is the horizontal distance of a target object under the shooting distance M;

the method of calculating horizontal deviation and vertical deviation under the shooting distance S in step 3) is as follows:

when the user selects a different gun type, the sighting system can automatically select the sight height $H_x$, the sight bead height $H'_x$ and the horizontal distance $w1_x$ between the sight and the sight bead corresponding to the gun type in the built-in gun parameter table according to the gun type, and then the sighting angle $\alpha_x$ is calculated, $L_x$ is the distance of the target object under the shooting distance $M_x$, and the horizontal distance $L_x$ under different distance $M_x$ is calculated:

$$L_X=\tan \beta^*M_x$$

a fixed included angle $\theta$ is formed within a target plane, the included angle $\theta$ is determined by the installation error, $\overline{x_1}$ represents the mean deviation of the impact point in the horizontal direction from the target point in the 1st shooting, $\overline{y_1}$ represents the mean deviation of the impact point in the vertical direction from the target point in the 1st shooting, and according to the calculated deviation means $\overline{x1}$ and $\overline{y1}$ it can be obtained:

$$\theta=\arctan(\overline{x1}/(\overline{y1}-h))$$

at the moment, the horizontal deviation x and the vertical deviation y of the target point and the actual impact point can be obtained:

$$x=\tan\beta*\sin\theta*M_x$$

$$y=\tan\beta*\cos\theta*M_x+((H_x-H'_x)/w1)*M_x$$

Further, according to the deviation matching fitting algorithm based on a shooting angle, in combination with the built-in distance in the gun shooting parameter table as well as the sight height, the sight bead height and the horizontal distance between the sight bead and the sight under the distance, x and y deviation values under each fixed point distance are calculated and stored in the database; in the normal shooting process, the measured shooting distance is matched with the database one by one; if the distance is equal to a certain fixed point distance in the database, the deviation values are directly read; and if the distance S is between two fixed point shooting distances $M_p$ and $M_q$, the impact point under the distance S is regarded between the points p and q; the deviations can be calculated according to the following formulas:

$$x_s=(x_q-x_p)*(S-M_p)/(M_q-M_p)+x_p$$

$$y_s=(y_p-y_q)*(S-M_p)/(M_q-M_p)+y_p$$

wherein, $x_p$ is the horizontal deviation of the impact point at the point p, $x_q$ is the horizontal deviation of the impact point at the point q, $y_p$ is the vertical deviation of the impact point at the point p, and $y_q$ is the vertical deviation of the impact point at the point q.

Further, the first three steps of the compensation fitting algorithm based on a shooting angle are the same as the corresponding steps of the deviation matching fitting algorithm based on a shooting angle, and the fourth step comprises: the impact point under a random distance is calculated according to the corresponding deviation values of two shooting distances in combination with a gravitational deviation value; the influence of gravitational acceleration is considered in the compensation fitting algorithm based on a shooting angle, so that the aimed target is more accurate; the shortest distance point is selected for shooting from the built-in gun shooting parameter table, then horizontal and vertical mean deviations are obtained, the horizontal and vertical deviations of the second distance in the gun shooting parameter table are calculated, the two deviation values are stored, and the impact point under a random distance is calculated in combination with the gravitational deviation.

Further, the fourth step of the compensation fitting algorithm based on a shooting angle is shown as follows:

after the flight distance of the bullet exceeds $M_2$, ignoring the influence of environmental factors, wherein the horizontal deviation is mainly determined by the installation error of the sighting mirror, so the calculation of the horizontal deviation is regards as being in a linear relation;

the flight trajectory can be decomposed into a horizontal distance and a vertical distance; it is supposed that $\overline{x_1}$ is horizontal deviation when the horizontal distance is L1, $\overline{x_2}$ is horizontal deviation when the horizontal distance is L2 and x3 is to-be-solved horizontal deviation fitted when the horizontal distance of the bullet at the target point is L3, and the calculation method is as follows:

$$x3=(L3/L1)*\overline{x_1}*X_Coefficient$$

or $$x3=(L3/L2)*\overline{x_2}*X_Coefficient$$

wherein X_Coefficient is a built-in horizontal adjustment coefficient injected before leaving the factory;

the vertical deviation when the bullet flies the horizontal distance L3 is y3, the vertical deviation of L3 comprises actual fall after the bullet flies the distance L2 and also comprises inherent deviation from the horizontal distance L2 to the distance L3 and drop caused by superposing the gravitational acceleration, and the vertical deviation calculation method after the bullet flies the horizontal distance L3 is obtained:

$$y3=\left(\frac{(L3-L2)*(y2-\overline{y_1})}{L2-L1}+y2\right)*\text{Y_Coefficien}+\left(\frac{(L3-L2)*(L3-L2)}{(L2-L1)*(L2-L1)}*\left(y2-\frac{\overline{y_1}*L2}{L1}\right)*\text{H_Coefficient}\right.$$

wherein, y1 is the solved vertical deviation at the horizontal distance L1, y2 is the vertical deviation at the horizontal distance L2, y3 is the vertical deviation at the horizontal distance L3, Y_Coefficient is a built-in longitudinal adjustment coefficient before equipment leaves the factory, H_Coefficient is a built-in gravitational deviation adjustment coefficient before the equipment leaves the factory and is related to such factors as local latitude and the like, S' is the actual distance of the second calibration point, and $\overline{y_1}$ and $\overline{y_2}$ are respectively horizontal deviation means under the horizontal distances L1 and L2.

Further, the ranging unit comprises a signal transmitting end and a signal receiving end; the view field acquisition unit comprises an optical image acquisition end; the signal transmitting end, the signal receiving end and the optical image acquisition end are all arranged at the front end of the shell, and the display unit is arranged at the rear end of the shell; and a protection unit is arranged at the front end of the shell and buckled on the front end of the shell.

Further, the photoelectric sighting system further comprises two view field adjusting units, one view field adjusting unit is arranged on the display unit, while the other view field adjusting unit is arranged on the shell; the display unit also displays shooting assisting information and working indication information, and the category and the arrangement mode of the information can be set according to the requirements of users.

Further, the sighting circuit unit comprises an interface board and a core board; a view field driving circuit of the view field acquisition unit, a ranging control circuit in the ranging unit, a key control circuit of a key unit and a battery control circuit of a battery pack are all connected to the core board via the interface board; a display driving circuit of the display unit is connected to the core board;

a memory card can be inserted into the core board; a bullet information database, a gun shooting parameter table and a shooting angle fitting algorithm are set in the memory card; a user can call the gun shooting parameter table according to the used gun to acquire corresponding gun parameter information, call the bullet information database according to the used bullet to acquire corresponding bullet parameter information, and realize precise positioning of the photoelectric sighting system by adopting the shooting angle fitting method.

The features of the present invention will be described in more details by combining the accompanying drawings in detailed description of various embodiments of the present invention below.

DETAILED DESCRIPTION OF THE EMBODIMENTS

In order to make the purposes, technical solutions and advantages of the present invention clearer, the present invention will be further described in detail below in combination with the accompanying drawings and the embodiments. It should be understood that the specific embodiments described herein are merely used for interpreting the present invention, rather than limiting the present invention.

On the contrary, the present invention covers any substation, modification, equivalent method and solution defined by the claims within the essence and scope of the present invention. Further, in order to make the public better understand the present invention, some specific details are described below in the detail description of the present invention.

The present invention provides a shooting angle fitting method for an integrated precision photoelectric sighting system, the photoelectric sighting system may be installed on multiple types of sporting guns, e.g., rifles and the like, and the photoelectric sighting system may also be installed on pistols, air guns or other small firearms. When the photoelectric sighting system of the present invention is installed on a gun, it can be firmly and stably installed on an installation track or a reception device of the gun via an installer, the installer is of a known type of technology, the installer adopted in the present invention can adapt to the installation tracks or reception devices of different guns and can adapt to the different installation tracks or reception devices via an adjusting mechanism on the installer, and the photoelectric sighting system and the gun are calibrated by using a calibration method or calibration equipment for a gun and a sighting telescope after installation.

Figure 1:
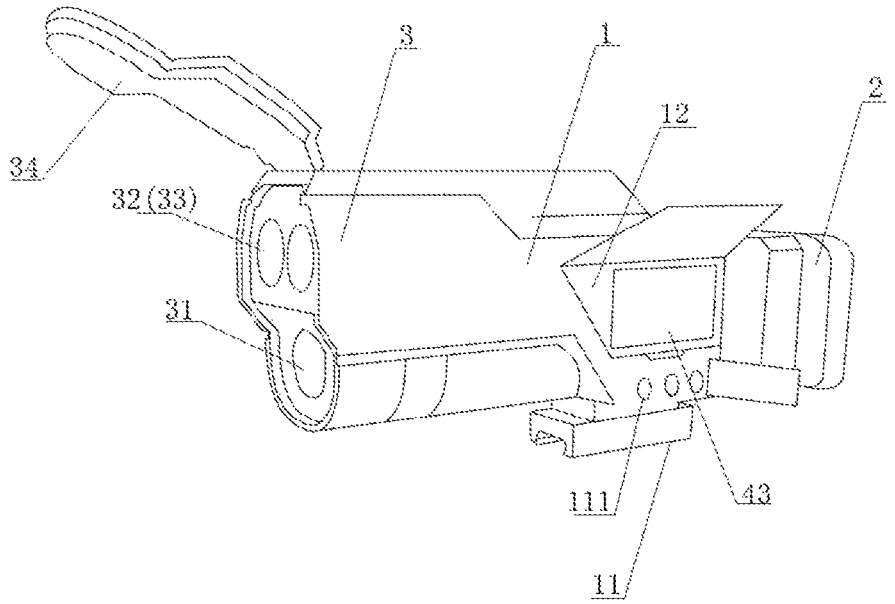
FIG. 1 is an appearance structural diagram of a photoelectric sighting system in an embodiment of the present invention.
Figure 2:
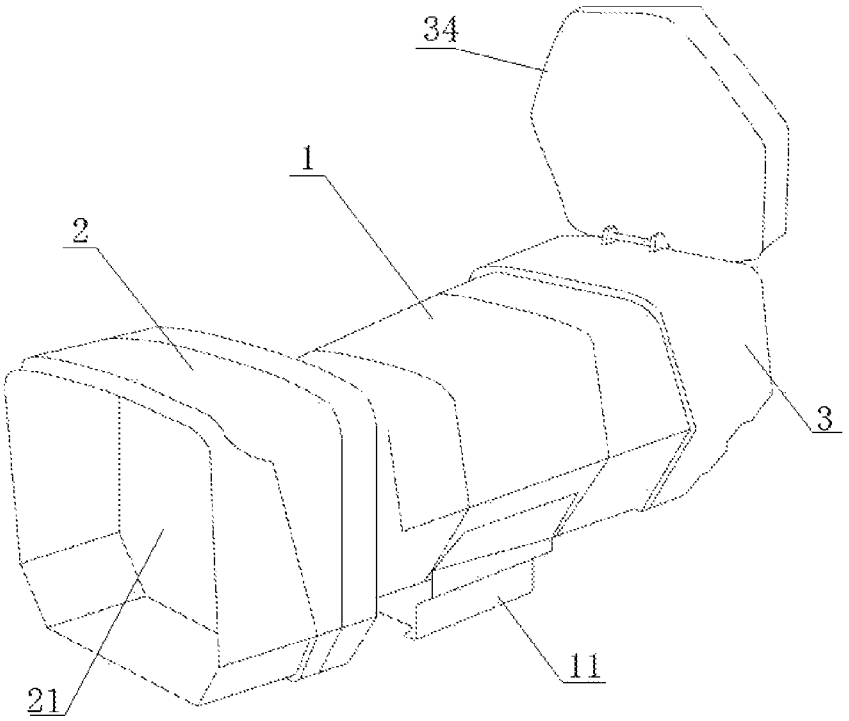
FIG. 2 is another appearance structural diagram of the photoelectric sighting system in an embodiment of the present invention.

FIG. 1 is an external structural schematic diagram of a photoelectric sighting system in an embodiment of the present invention, and FIG. 2 is another external structural schematic diagram of a photoelectric sighting system in an embodiment of the present invention. The photoelectric sighting system includes a shell 1, the shell 1 determines the size of the photoelectric sighting system and the size of circuits inside the shell 1, and the shell 1 defines an internal space for accommodating a view field acquisition unit 31, a display unit 21 and even more components; meanwhile, the shell 1 includes a shell front end 3 and a shell rear end 2, specifically, the view field acquisition unit 31 is installed at the front end, the view field acquisition end of the view field acquisition unit 31 is arranged inside the shell front end 3, the view field acquisition unit 31 is used for acquiring video information within the view field, the display unit 21 is installed at the shell rear end, and the display unit 21 at least can simultaneously display the video information acquired by the view field acquisition unit 31 and a cross division line for sighting; and the video information acquired by the view field acquisition unit 31 is transmitted to the display unit via a sighting circuit unit arranged inside the shell.

The present invention adopts the structure with the shell front end and the shell rear end which can be separately replaced, and when a component of the photoelectric sighting system is damaged, the space where the component is correspondingly located and the shell can be replaced to repair the photoelectric sighting system, or the space where the component is correspondingly located and the shell are detached and the damaged component is separately replaced to repair the photoelectric sighting system.

In other embodiments, the display unit 21 may simultaneously display the video information acquired by the view field acquisition unit 31, a cross division line for sighting, information for assisting shooting and functional information; the information for assisting shooting includes information acquired by sensors, such as distance information, horizontal angle information, vertical elevation information and the like; and the functional information includes functional menus, magnifying power adjustment, battery capacity, remaining record time and the like.

The view field acquisition unit 31 includes an objective (objective combination) or other optical visible equipment with a magnifying function, which is installed at the front end of the view field acquisition unit 31 to increase the magnifying power of the view field acquisition unit.

The whole photoelectric sighting system may be a digital device, and can communicate with a smart phone, a smart terminal, a sighting device or a circuit and transmit the video information acquired by the view field acquisition unit 31 to it; and the video information acquired by the view field acquisition unit 31 is displayed by the smart phone, the smart terminal or the like.

In one embodiment, the view field acquisition unit 31 may be an integrated camera, the magnifying power of the lens of the view field acquisition unit 31 can be selectively changed according to practical application, the integrated camera adopted in the present invention is a 3-18× camera manufactured by Sony Corporation but is not limited to the above model and magnifying power, the integrated camera is arranged at the forefront of the photoelectric sighting system, meanwhile, a UV lens and a lens cover 34 are equipped at the front end of the integrated camera, and the lens cover 34 can turn over 270 degrees to completely cover the shell front end. Therefore, the view field acquisition unit is protected from being damaged, and the lens is protected and is convenient to clean.

Figure 3:
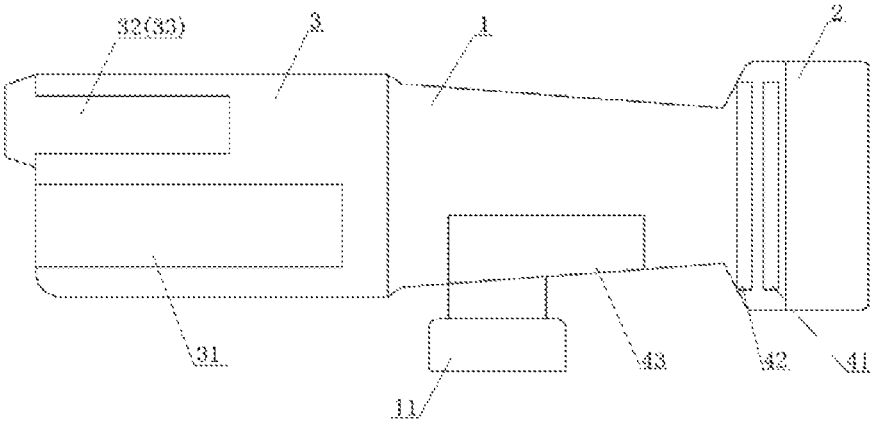
FIG. 3 is a structural section view of the photoelectric sighting system in an embodiment of the present invention.

As shown in FIG. 2 and FIG. 3, in the above embodiment, the photoelectric sighting system includes a range finder, the range finder is a laser range finder, and the laser range finder is located inside the shell 1 and is a pulse laser range finder.

Figure 4:
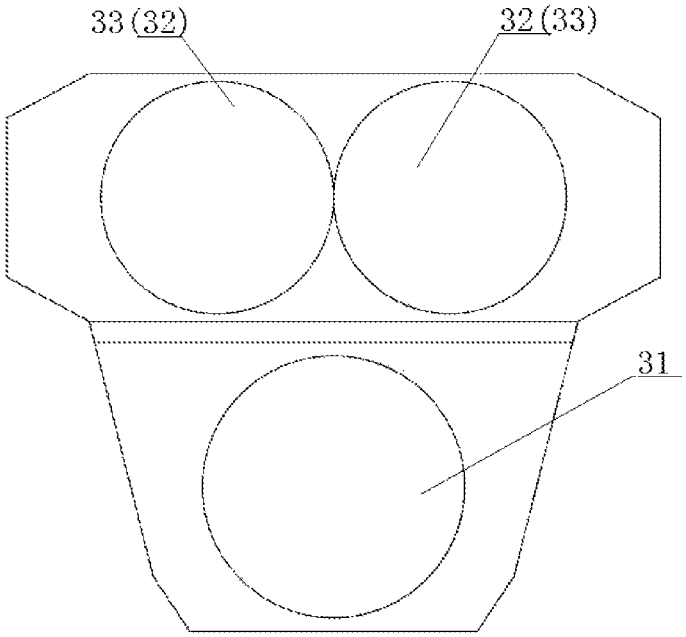
FIG. 4 is a schematic diagram of the front end of a shell of the photoelectric sighting system in an embodiment of the present invention.

As shown in FIG. 4, the laser range finder includes a laser transmitting end 32 and a laser receiving end 33 which are arranged at the front end of the shell 1 and symmetrically distributed on the camera of the integrated camera, and the laser transmitting end 32, the laser receiving end 33 and the camera of the integrated camera constitute an equilateral inverted triangle or an isosceles inverted triangle; both the laser transmitting end 32 and the laser receiving end 33 protrude from the front end of the shell 1, the laser transmitting end 32, the laser receiving end 33 and the lens of the view field acquisition unit 31 have certain height difference, and the laser transmitting end 32 and the laser receiving end 33 protrude from the shell front end 3, and such a design reduces the shell internal space occupied by the laser range finder; the overlong parts of the laser transmitting end 32 and the laser receiving end 33 protrude from the shell front end 3 to realize high integration of the internal space of the shell 1, so that the photoelectric sighting system is smaller, more flexible and lighter; in addition, because the objective thickness of the view field acquisition unit is generally higher than the lens thicknesses of the laser transmitting end and the laser receiving end, this design can reduce the error of laser ranging.

The lens cover 34 proposed in the above embodiment simultaneously covers the front end of the laser range finder while covering the view field acquisition unit, thereby protecting the laser range finder from being damaged.

A laser source is arranged in the laser transmitting end 32, the laser source transmits one or more laser beam pulses within the view field of the photoelectric sighting system under the control of a control device or a core board of the photoelectric sighting system, and the laser receiving end 33 receives reflected beams of the one or more laser beam pulses and transmits the reflected beams to the control device or the core board of the photoelectric sighting system; the laser transmitted by the laser transmitting end 32 is reflected by a measured object and then received by the laser receiving end 33, the laser range finder simultaneously records the round-trip time of the laser beam pulse, and half of the product of the light velocity and the round-trip time is the distance between the range finder and the measured object.

The sighting circuit unit arranged in the shell 1 and used for connecting the view field acquisition unit 31 with the display unit 21 includes a CPU core board 41 and an interface board 42, the interface board 42 is connected with the CPU core board 41, specifically, the input/output of the CPU core board 41 is connected via a serial port at the bottom of the interface board 42, and the CPU core board 41 is arranged on one side of a display screen of the display unit 21 facing the interior of the shell 1; the interface board 42 is arranged on one side of the CPU core board 41 opposite to the display screen; the display screen, the CPU core board 41 and the interface board 42 are arranged in parallel; the integrated camera and the range finder are separately connected to the interface board 42 by connecting wires; the image information acquired by the integrated camera and the distance information acquired by the range finder are transmitted to the CPU core board 41 via the interface board 42, and the information is displayed on the display screen via the CPU core board 41.

The CPU core board 41 can be connected with a memory card via the interface board 42 or directly connected with a memory card, in the embodiment of the present invention, a memory card slot is formed at the top of the CPU core board 41, the memory card is inserted into the memory card slot, the memory card can store information, the stored information can be provided to the CPU core board 41 for calculation based on the shooting angle fitting method, and the memory card can also store feedback information sent by the CPU core board 41.

A USB interface is also arranged on the side of the memory card slot at the top of the CPU core board 41, and the information of the CPU core board 41 can be output or software programs in the CPU core board 41 can be updated and optimized via the USB interface.

The photoelectric sighting system further includes a plurality of sensors, specifically some or all of an acceleration sensor, a wind velocity and direction sensor, a geomagnetic sensor, a temperature sensor, an air pressure sensor and a humidity sensor (different sensor data can be acquired according to the selected shooting angle fitting method).

In one embodiment, the sensors used in the photoelectric sighting system only include an acceleration sensor and a geomagnetic sensor, and the other sensors can be used for other algorithms or trajectory equations.

A battery compartment 12 is also arranged in the shell 1, a battery pack 43 is arranged in the battery compartment 12, a slide way is arranged in the battery compartment 12 to facilitate plugging and unplugging of the battery pack 43, the battery compartment 12 is arranged at the bottom of the middle part in the shell 1, and the battery pack 43 can be replaced by opening a battery compartment cover from the side of the shell 1; in order to prevent tiny size deviation of batteries of the same model, a layer of sponge (or foam or expandable polyethylene) is arranged inside the battery compartment cover; and the sponge structure arranged inside the battery compartment cover can also prevent instability of the batteries due to the shooting vibration of a gun.

A battery circuit board is arranged on the battery pack 43, the battery pack 43 supplies power to the components of the photoelectric sighting system via the battery circuit board, and the battery circuit board is simultaneously connected with the CPU core board 41 via the interface board 42.

External keys are arranged on one side close to the display unit 21 outside the shell 1 and connected to the interface board 42 via a key control board inside the shell 1, the information on the display unit 21 can be controlled, selected and modified by pressing the external keys, and the external keys are specifically at 5-10 cm close to the display unit.

Moreover, the external keys are specifically arranged on the right side of the display unit, but not limited to said position and should be arranged at the position facilitating use and press of a user, the user controls the CPU core board 41 via the external keys, the CPU core board 41 drives the display screen to realize display, and the external keys can control the selection of one shooting target within an observation area displayed by the display unit, or control the photoelectric sighting system to start the laser range finder, or control a camera unit of the photoelectric sighting system to adjust the focal distance of the sighting telescope, etc.

In another embodiment, the key control board for the external keys may be provided with a wireless connection unit and is connected with an external device via the wireless connection unit, the external device includes a smart phone, a tablet computer or the like, and then the external device loads a program to control the selection of one shooting target within the observation area displayed by the display unit, or control the photoelectric sighting system to start the laser range finder, or control the camera unit of the photoelectric sighting system to adjust the focal distance of the sighting telescope, etc.

An external socket slot 111 is also formed on the outer side of the shell 1, and the part of the external socket slot 111 inside the shell is connected with the key control board as a spare port, so that the external keys are used according to user demands, and a user can control the selection of one shooting target within the observation area displayed by the display unit 2, or control the photoelectric sighting system to start the laser range finder, or control the camera unit of the photoelectric sighting system to adjust the focal distance of the sighting telescope, or the like via the external keys.

The external socket slot 111 can also be connected with other operating equipment, auxiliary shooting equipment or video display equipment or transmit information and video, and the other operating equipment includes an external control key, a smart phone, a tablet computer, etc.; in one embodiment, the operating equipment connected with the external socket slot 111 may select one target within the observation area, start the laser range finder, adjust the focal distance of the sighting telescope or the like.

The display unit 21 is an LCD display screen on which a touch operation can be realized, and the size of the display screen can be determined according to actual needs and is 3.5 inches in the present invention.

In one embodiment, the resolution of the LCD display screen is 320*480, the working temperature is −20±70° C., the backlight voltage is 3.3 v, the interface voltage of the liquid crystal screen and the CPU is 1.8 v, and the touch screen is a capacitive touch screen.

The cross division line (sight bead) displayed on the display screen is superposed with the video information acquired by the view field acquisition unit, the cross division line is used for aimed shooting, and the display screen also displays auxiliary shooting information used for assisting shooting and transmitted by the above sensors and working indication information.

One part of the shooting assisting information is applied to a shooting angle fitting method, while the other part is displayed for reminding a user.

The photoelectric sighting system may further include one or more ports and a wireless transceiving unit, which may communicate with a smart phone or other terminal equipment by wired or wireless connection.

Based on the structure of the photoelectric sighting system above, the CPU core board 41 is further connected with a memory card in which a bullet information database, a gun shooting parameter table and a shooting angle fitting method are set; and a user can call the gun shooting parameter table according to the used gun to acquire corresponding gun parameter information, call the bullet information database according to the used bullet to acquire corresponding bullet parameter information, and realize precise positioning of the photoelectric sighting system by adopting the shooting angle fitting method. The bullet information database needs to be called in other embodiments, but not called in the embodiments of the present invention.

In the present invention, a shooting angle fitting method adapting to various environments without environmental parameters is studied out based on a sighting system of a gun itself in combination with physical science and ballistic science, to realize accurate positioning of a photoelectric sighting system.

The sighting principle of a gun is actually the rectilinear propagation principle of light; because the bullet is subjected to gravity during flying, the position of an impact point is necessarily below the extension line of the gun bore line; according to the rectilinear propagation principle of light, the sight bead, the sight and the target point form a three-point line, a small included angle is thus formed between the connecting line between the sight bead and the sight and the trajectory of the bullet, and the crossing point of the included angle is the shooting starting point of the bullet, so the sight is higher than the sight bead. Each model of gun has its own fixed shooting parameter table, the parameter table records height parameter values of the sight bead and the sight under different distances, and the target can be accurately hit only if the corresponding parameters of the sight bead and the sight are adjusted under different shooting distances.

In one embodiment, the shooting angle fitting method describes a deviation matching fitting algorithm based on a shooting angle.

Specific parameters of the gun used by the user are determined in the gun shooting parameter table, the following formulas are all derived taking horizontal shooting (i.e., the bore extension line is perpendicular to the target plane during shooting) as an example, and downward shooting or overhead shooting is deduced according to the following deduction logics. The shooting distance is accurately measured by the ranging unit in the photoelectric sighting system. When the target shooting distance is M, the same target is shot n (n>=1) times, and n times of shooting accumulated deviation X of the impact point in the horizontal direction (transverse) from the target point and n times of shooting accumulated deviation Y of the impact point in the vertical direction from the target point are obtained by the following formulas:

$$X=\Sigma_{i=0}^{n}X_i \tag{1}$$

$$Y=\Sigma_{i=0}^{n}Y_i \tag{2}$$

wherein, $X_i$ represents deviation of the impact point in the horizontal direction from the target point in $i^{th}$ shooting;

$Y_i$ represents deviation of the impact point in the vertical direction from the target point in $i^{th}$ shooting.

The mean deviations of the shot impact point in the horizontal direction and the vertical direction from the target point are obtained:

$$\overline{x_i} = \frac{X}{n} \tag{3}$$

$$\overline{y_i} = \frac{Y}{n} \tag{4}$$

wherein, $\overline{x_i}$ represents the mean deviation of the impact point in the horizontal direction from the target point in the $i^{th}$ shooting;

wherein, $\overline{y_i}$ represents the mean deviation of the impact point in the vertical direction from the target point in the $i^{th}$ shooting.

Figure 5:
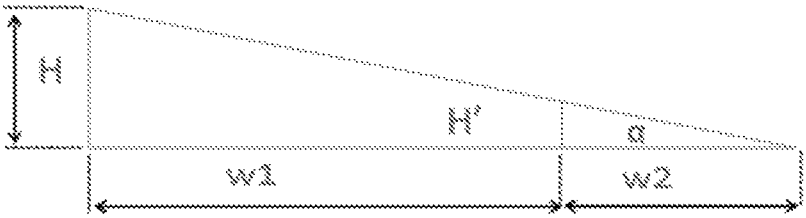
FIG. 5 is a schematic diagram of a gun sighting parameter corresponding relation of the photoelectric sighting system in an embodiment of the present invention.

As shown in FIG. 5, a bullet information database, a gun shooting parameter table and a shooting angle fitting method are set in the memory card; and according to the built-in gun sighting parameter table set in the factory and the model of the gun used, the following parameters can be obtained: sight height H, sight bead height H', distance w1 between the sight and the sight bead, and distance w2 between the sight bead and the muzzle.

1) The included angle α between the barrel axis of a gun used by a user and a sighting line is calculated.

Calculated according to the approximate triangle principle is:

$$H'/H=w2(w1+w2) \tag{5}$$

Obtained is:

$$w1+w2=H*w2/H' \tag{6}$$

Wherein, $$w2=(w1*H')/(H-H') \tag{7}$$

Obtained is:

$$\tan \alpha=(H-H')/w1 \tag{8}$$

2) The included angle β between the bore extension line of the gun used by the user and the optical axis of the sighting mirror under the shooting distance M is calculated.

Figure 6:
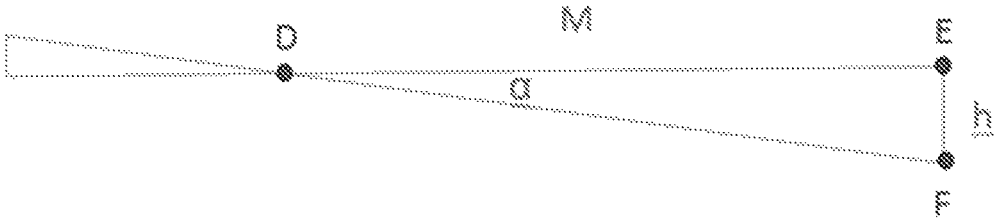
FIG. 6 is a schematic diagram of diagonal triangles constituted by connection lines of a sight, a sighting line and a bore extension line of a gun and a target object in an embodiment of the present invention.

As shown in FIG. 6, the connection lines of the sight, the sighting line, the bore extension line and the target object constitute diagonal triangles, and then the following formula can be obtained:

$$h=\tan \alpha*M \tag{9}$$

Figure 7:
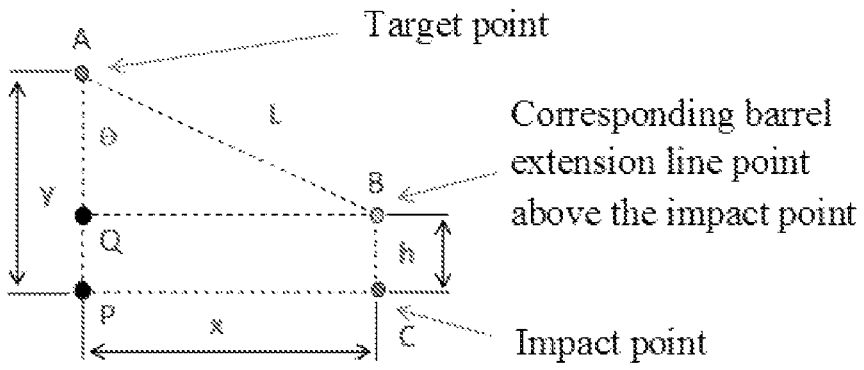
FIG. 7 is a schematic diagram of a plane formed by a target point, an impact point and a barrel extension line of the photoelectric sighting system in an embodiment of the present invention.

As shown in FIG. 7, by calculating the impact point C of n (n>=1) times of shooting and ignoring the effect of environmental factors in the horizontal direction, the height h above the impact point is regarded as a barrel axis extension line point B. Within the target object plane, the figure is constituted by the connection lines of the intersection A of the optical axis of the sighting mirror and the target object plane, the intersection B of the bore extension line and the target object plane, the impact point C, the intersection Q of the vertical line passing the point A and the horizontal line passing the point B within the target plane, and the intersection P of the extension line of AQ and the horizontal line passing the point C. The point Q is the intersection of the central point of the optical axis of the sighting mirror in the vertical direction and the bore extension line in the horizontal direction, the point P is the intersection of the central point of the optical axis of the sighting mirror in the vertical direction and the impact point in the horizontal direction, and the distance L between the projection points of the optical axis center of the sighting mirror and the bore extension line on the target plane under the distance M is calculated via the actually measured horizontal deviation value distance x and vertical deviation value distance y after shooting:

$$L=\sqrt{(y-h)^2+x^2} \tag{10}$$

Figure 8:
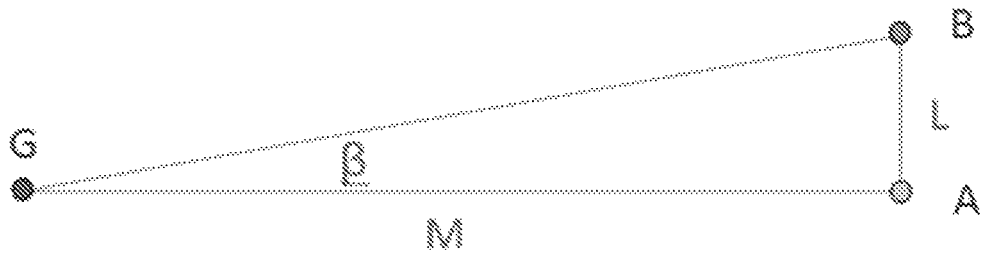
FIG. 8 is a schematic diagram of a right triangle constituted by the optical axis center of the photoelectric sighting system, the intersection of the optical axis on a target plane and the intersection of the barrel axis extension line on the target plane in an embodiment of the present invention.

As shown in FIG. 8, a right angle is constituted by connecting the optical axis center G of the sighting mirror, the intersection A of the optical axis on the target plane and the intersection B of the bore extension line on the target plane, and then it can be obtained:

$$\tan \beta=L/M \tag{11}$$

wherein, L is the horizontal distance of the target object under the shooting distance M.

In combination with FIG. 7, AB and AQ form a fixed included angle θ within the target plane, the included angle is determined by the installation error, and according to the calculated deviation means $\overline{x_1}$ and $\overline{y_1}$, it can be obtained:

$$\theta=\arctan(\overline{x1}/(\overline{y1}-h)) \tag{12}$$

When the user selects different gun type, the sighting system can automatically select the sight height $H_x$, the sight bead height $H'_x$ and the horizontal distance $w1_x$ between the sight and the sight bead corresponding to the gun type in the built-in gun parameter table according to the gun type, and then the sighting angle $\alpha_x$ is calculated. As shown in FIGS. 5, 6, 7 and 8, $L_x$ is the distance of the target object under the shooting distance $M_x$, and the horizontal distance $L_x$ under different distance $M_x$ is calculated:

$$L_X=\tan \beta*M_x \tag{13}$$

At the moment, the horizontal deviation x and the vertical deviation y of the target point and the actual impact point can be obtained:

$$x=\tan \beta*\sin \theta*M_x \tag{14}$$

$$y=\tan \beta*\cos \beta*M_x+((H_x-H'_x)/w1)*M_x \tag{15}$$

Figure 9:
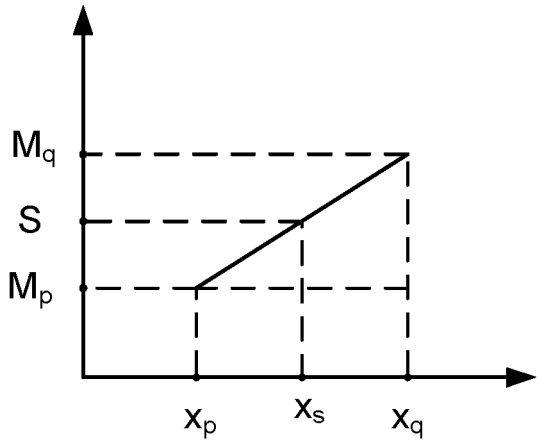
FIG. 9 is a schematic diagram of horizontal deviation of the impact point of the photoelectric sighting system in an embodiment of the present invention.
Figure 10:
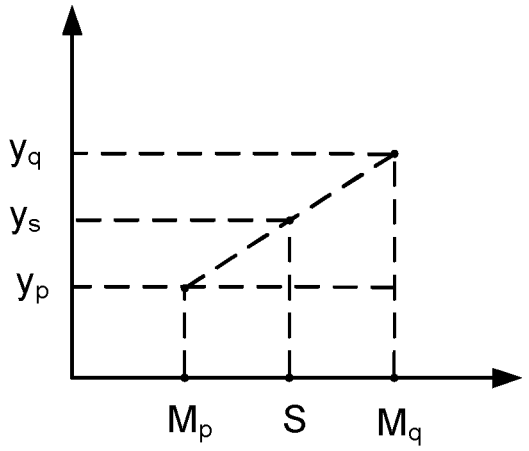
FIG. 10 is a schematic diagram of vertical deviation of the impact point of the photoelectric sighting system in an embodiment of the present invention.

According to the above deviation calculation formulas of x and y, in combination with the built-in distance in the gun shooting parameter table as well as the sight height, the sight bead height and the horizontal distance between the sight bead and the sight under the distance, x and y deviation values under each fixed point distance are calculated and stored in the database; in the normal shooting process, the measured shooting distance is matched with the database one by one; if the distance is equal to a certain fixed point distance in the database, the deviation values are directly read; and if the distance S is between two fixed point shooting distances $M_p$ and $M_q$, the impact point under the distance S is regarded between the points p and q. FIG. 9 and FIG. 10 are respectively schematic diagrams of the horizontal deviation and the vertical deviation of the impact point, and the deviations can be calculated according to the following formulas:

$$x_s=(x_q-x_p)*(S-M_p)/(M_q-M_p)+x_p \tag{16}$$

$$y_s=(y_p-y_q)*(S-M_p)/(M_q-M_p)+y_p \tag{17}$$

wherein, $x_p$ is the transverse deviation of the impact point at the point p, $x_q$ is the transverse deviation of the impact point at the point q, $y_p$ is the longitudinal deviation of the impact point at the point p, and $y_q$ is the longitudinal deviation of the impact point at the point q.

In another embodiment, the shooting angle fitting method describes a compensation fitting algorithm based on a shooting angle, which is imported based on the deviation matching fitting algorithm based on the shooting angle. The influence of gravitational acceleration is added to the compensation fitting algorithm based on a shooting angle, so that the aimed target is more accurate.

Figure 11:
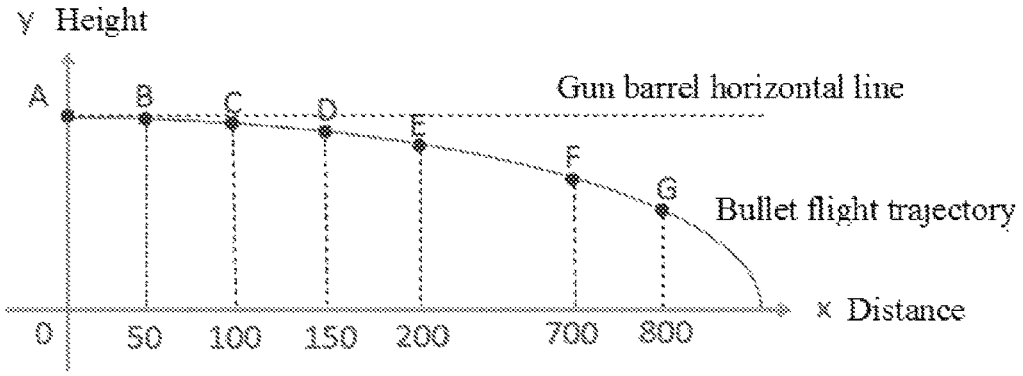
FIG. 11 is a schematic diagram of a bullet flight trajectory of the photoelectric sighting system in an embodiment of the present invention.

After the flight distance of the bullet exceeds $M_2$, the drop height difference of the bullet is increasingly large due to the reduction of the velocity of the bullet and the action of the vertical acceleration, and the trajectory of the bullet is as shown in FIG. 11.

Figure 12:
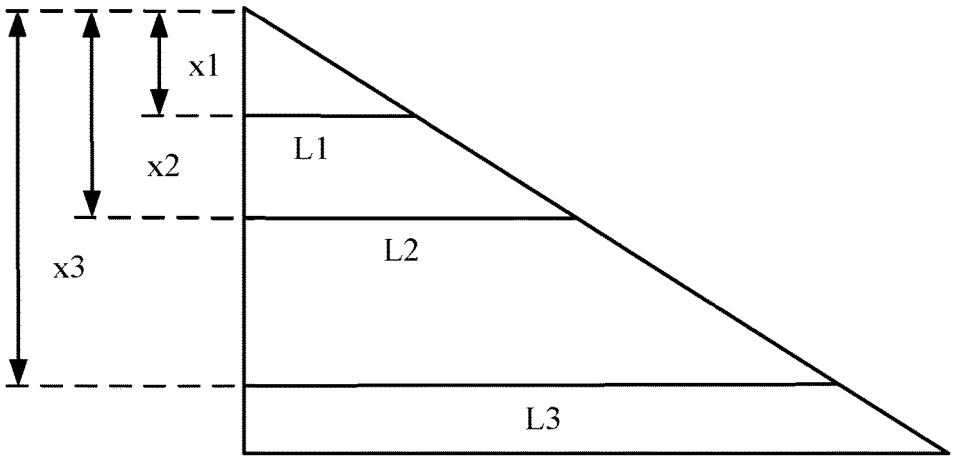
FIG. 12 is a schematic diagram of a relation between the horizontal deviation of the photoelectric sighting system and the target distance in an embodiment of the present invention.

As shown in FIG. 12, the sighting system needs to perform deviation compensation calculation on the impact point. Under the condition of ignoring the influence of environmental factors, the horizontal deviation is mainly determined by the installation error of the sighting mirror, and the installation error is fixed, so the horizontal deviation and the horizontal distance can be regarded as having a linear relation in calculation.

The flight trajectory can be decomposed into a horizontal distance and a vertical distance; it is supposed that $\overline{x_1}$ is horizontal deviation when the horizontal distance is L1, $\overline{x_2}$ is horizontal deviation when the horizontal distance is L2 and x3 is to-be-solved horizontal deviation fitted when the horizontal distance of the bullet at the target point is L3, and the calculation method is as follows:

$$x3=(L3/L1)*\overline{x1}*X_\text{Coefficient} \tag{18}$$

or $$x3=(L3/L2)*\overline{x2}*X_\text{Coefficient} \tag{19}$$

wherein X_Coefficient is a built-in horizontal adjustment coefficient injected before leaving the factory, and is related to the models and installation of the gun and bullets.

Figure 13:
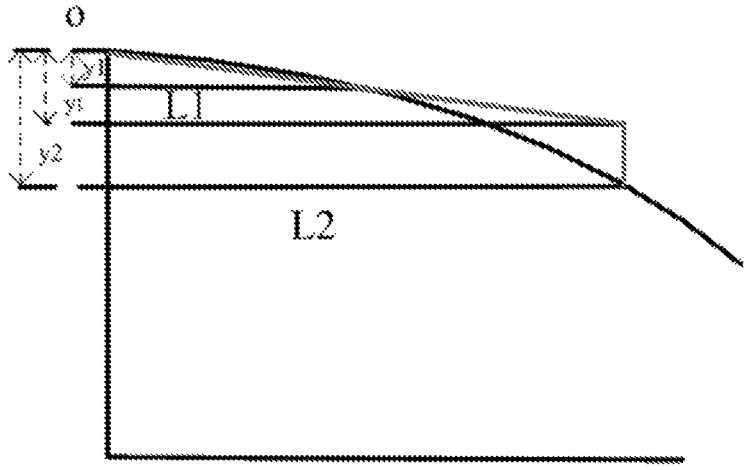
FIG. 13 is a schematic diagram of a position change relation when the bullet of the photoelectric sighting system flies from the horizontal distance L1 to the horizontal distance L2 in an embodiment of the present invention.
Figure 14:
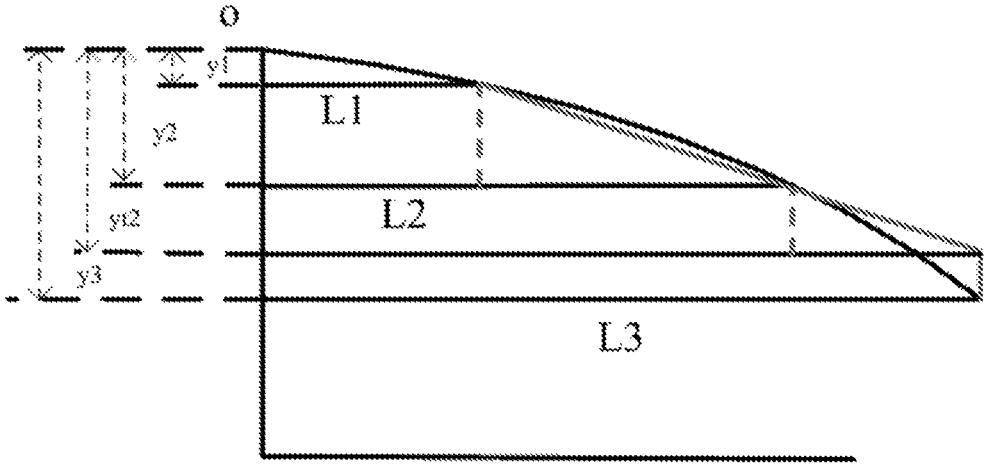
FIG. 14 is a schematic diagram of a position change relation when the bullet of the photoelectric sighting system flies from the horizontal distance L2 to the horizontal distance L3 in an embodiment of the present invention.

As shown in FIG. 13 and FIG. 14, the vertical deviation of the horizontal distance L3 is y3, and the vertical deviation includes actual fall after the bulletin flies the distance L2, and also includes inherent deviation from the horizontal distance L2 to the horizontal distance L3 and fall caused by superposing the gravitational acceleration, wherein the inherent deviation is a vertical component of the installation error; t is time when the bullet flies from the horizontal distance L1 to the horizontal distance L2, and v is velocity when the bullet arrives at the horizontal distance L2; because the flight distance of the bullet from the horizontal distance L1 to the distance L2 is very short, it is regarded that the velocity of the bullet from the horizontal distance L1 to the distance L2 is consistent, the influence of environmental factors is ignored; and g is gravitational acceleration. In the process of flying from the horizontal distance L1 to the distance L2, the vertical deviation of the bullet is only the deviation caused by the vertical installation error in the absence of gravity, and then when the bullet accomplishes the flight of the horizontal distance L2, its longitudinal impact point is at yt, and yt is between y1 and y2; and in the presence of gravitational acceleration, when the bullet accomplishes the flight of the horizontal distance L2, the longitudinal impact point is at y2, wherein the values of y1 and y2 are mean deviation values of the two calibration points. If the gravity is not considered when the bullet is at the horizontal distance L1, the bullet only arrives at yt in the vertical direction when flying the horizontal distance L2 under the action of only the angular deviation, and it can be obtained according to the triangle principle:

$$yt=\overline{y_1}*L2/L1 \tag{20}$$

Thus, the flight time calculation method from y1 to y2 is obtained as follows:

$$t=\sqrt{2*(y2-\overline{y_1}*L2/L1/g} \tag{21}$$

$$v=(L2-L1)/t \tag{22}$$

It is supposed that h is deviation caused by gravity when the bullet flies from the horizontal distance L2 to the distance L3, yt2 is a longitudinal height deviation value of flight from the horizontal distance L2 to the distance L3 when only the inherent deviation is considered but the gravity is not considered, Y_Coefficient is a built-in longitudinal adjustment coefficient before equipment leaves the factory, and H_Coefficient is a built-in gravitational deviation adjustment coefficient before the equipment leaves the factory and is related to such factors as local latitude and the like. In the absence of gravity, when the bullet flies from the horizontal distance L2 to the distance L3, the longitudinal impact point thereof is at yt2; in the presence of gravitational acceleration, when the bullet accomplishes the flight of the horizontal distance L3, the longitudinal impact point is at y3; the bullet flies at a high speed within an effective range; by ignoring the influence of environment, it is regarded that the bullet flies uniformly from the horizontal distance L2 to the distance L3, the velocity is the bullet velocity v at the horizontal distance L2, and it can be obtained according to the triangle principle:

$$yt2=(L3-L2)*(y2-\overline{y_1})/(L2-L1)+y2 \tag{23}$$

Thus, the vertical deviation calculation method after the bullet flies the horizontal distance L3 is obtained:

$$y3=yt2*Y_\text{Coefficient}+h*H_\text{Coefficient} \tag{24}$$

and then the following formula can be obtained:

$$y3=\left(\frac{(L3-L2)*(y2-\overline{y_1})}{L2-L1}+y2\right)*\text{Y_Coefficien}+\left(\frac{(L3-L2)*(L3-L2)}{(L2-L1)*(L2-L1)}*\left(y2-\frac{\overline{y_1}*L2}{L1}\right)*\text{H_Coefficient}\right. \tag{25}$$

In conclusion, according to the compensation fitting algorithm based on a shooting angle, the shortest distance point is selected for shooting from the built-in gun shooting parameter table, then horizontal and vertical mean deviations x and y are obtained, the calculation methods of x and y are worked out according to the sight principle, the horizontal and vertical deviations of the second distance in the gun shooting parameter table are calculated, the deviation values are stored, and the impact point under a random distance is calculated in combination with the gravitational deviation.

The invention claimed is:

1. A shooting angle fitting method for an integrated precision photoelectric sighting system, comprising:

acquiring an image of a target using a view field acquisition unit;

displaying the image of the target on a display unit;

determining a shooting distance between the target and the integrated precision photoelectric sighting system using a ranging unit;

wherein the photoelectric sighting system comprises a detachable shell housing the view field acquisition unit, the display unit, the ranging unit, a power supply, and a sighting circuit unit.

2. The shooting angle fitting method for an integrated precision photoelectric sighting system according to claim 1, wherein the shooting angle fitting method comprises a deviation matching fitting algorithm based on a shooting angle and a compensation fitting algorithm based on a shooting angle.

3. The shooting angle fitting method for an integrated precision photoelectric sighting system according to claim 2, wherein the deviation matching fitting algorithm comprises:

1) calculating an included angle α between a barrel axis of a first gun and a sighting line;
2) calculating an included angle β between the barrel axis of the first gun and an optical axis of a sighting mirror at a shooting distance M;
3) calculating a horizontal deviation and a vertical deviation of a second gun a shooting distance S; and
4) calculating fitted deviation values by matching the shooting distance and data in a database.

4. The shooting angle fitting method for an integrated precision photoelectric sighting system according to claim 3, wherein in step (1) of the deviation matching fitting algorithm, α is calculable according to $$\tan \alpha=(H-H')/w1$$

wherein H is a height of the sight, H' is the height of sight bead, and w1 is a distance between the sight and the sight bead, all of the first gun, wherein, in step (2), β is calculable according to $$\tan \beta=L/M,$$

wherein L is a horizontal distance of the target at the first shooting distance M, $$\tan \alpha=(H-H')/w1$$

wherein, in step (3), calculating a horizontal deviation x and a vertical deviation y of a target point and an actual impact point by the second gun according to:

$$x=\tan \beta*\sin \theta*M_x$$

$$y=\tan \beta*\cos \theta*M_x+((H_x-H'_x)/w1)*M_x$$

wherein $\theta=\arctan(\overline{x1}/(\overline{y1}-h))$, $H_x$ is the height of the sight, $H'_x$ is the height of the sight bead, and $M_x$ is a second shooting distance, all of the second gun, $\overline{x_1}$ represents a mean deviation of the impact point in the horizontal direction from the target point in the first shot, $\overline{y_1}$ represents a mean deviation of the impact point in the vertical direction from the target point in a first shot, all by the second gun, $$\theta=\arctan(\overline{x1}/(\overline{y1}-h)).$$

5. The shooting angle fitting method for an integrated precision photoelectric sighting system according to claim 4, wherein according to the deviation matching fitting algorithm based on a shooting angle, in combination with the built-in distance in the gun shooting parameter table as well as the sight height, the sight bead height and the horizontal distance between the sight bead and the sight under the distance, x and y deviation values under at a plurality of target distances are calculated and stored in the database; obtaining a measured shooting distance to the target in the field; comparing the measured shooting distance with the plurality of target distances in the database;

when the measured shooting distance equals one of the plurality of target distances in the database, obtaining x and y deviation values corresponding to the measured shooting distance;

when the measured shooting distance falls between two of the plurality of target distances $M_p$ and $M_q$ in the database, deviation values $x_s$ and $y_s$ are calculable according to $$x_s=(x_q-x_p)*(S-M_p)/(M_q-M_p)+x_p, \text{ and}$$

$$y_s=(y_p-y_q)*(S-M_p)/(M_q-M_p)+y_p$$

wherein $x_p$ is the horizontal deviation of the impact point at point p, $x_q$ is the horizontal deviation of the impact point at point q, $y_p$ is the vertical deviation of the impact point at point p, and $y_q$ is the vertical deviation of the impact point at point q.

6. The shooting angle fitting method for an integrated precision photoelectric sighting system according to claim 2, further comprising:

calculating the shooting distance according to the corresponding deviation values of two shooting distances in combination with a gravitational deviation value; the influence of gravitational acceleration is considered in the compensation fitting algorithm based on a shooting angle, so that the aimed target is more accurate; the shortest distance point is selected for shooting from the built-in gun shooting parameter table, then horizontal and vertical mean deviations are obtained, the horizontal and vertical deviations of the second distance in the gun shooting parameter table are calculated, the two deviation values are stored, and the impact point under a random distance is calculated in combination with the gravitational deviation.

7. The shooting angle fitting method for an integrated precision photoelectric sighting system according to claim 6, further comprising:

after the flight distance of the bullet exceeds $M_2$, ignoring the influence of environmental factors, wherein the horizontal deviation is mainly determined by the installation error of the sighting mirror, so the calculation of the horizontal deviation is regards as being in a linear relation;

the flight trajectory can be decomposed into a horizontal distance and a vertical distance; it is supposed that $\overline{x_1}$ is horizontal deviation when the horizontal distance is L1, $\overline{x_2}$ is horizontal deviation when the horizontal distance is L2 and x3 is to-be-solved horizontal deviation fitted when the horizontal distance of the bullet at the target point is L3, and the calculation method is as follows:

$$x3=(L3/L1)*\overline{x_1}*X_\text{Coefficient}$$

or $$x3=(L3/L2)*\overline{x_2}*X_\text{Coefficient}$$

wherein X_Coefficient is a built-in horizontal adjustment coefficient injected before leaving the factory;

the vertical deviation when the bullet flies the horizontal distance L3 is y3, the vertical deviation of L3 comprises actual fall after the bullet flies the distance L2 and also comprises inherent deviation from the horizontal distance L2 to the distance L3 and drop caused by superposing the gravitational acceleration, and the vertical deviation calculation method after the bullet flies the horizontal distance L3 is obtained:

$$y3 = \left(\frac{(L3 - L2) * (y2 - \overline{y_1})}{L2 - L1} + y2\right) * \text{Y_Coefficien} + \left(\frac{(L3 - L2) * (L3 - L2)}{(L2 - L1) * (L2 - L1)} * \left(y2 - \frac{\overline{y_1} * L2}{L1}\right) * \text{H_Coefficient}\right.$$

wherein, y1 is the solved vertical deviation at the horizontal distance L1, y2 is the vertical deviation at the horizontal distance L2, y3 is the vertical deviation at the horizontal distance L3, Y_Coefficient is a built-in longitudinal adjustment coefficient before equipment leaves the factory, H_Coefficient is a built-in gravitational deviation adjustment coefficient before the equipment leaves the factory and is related to such factors as local latitude and the like, S' is the actual distance of the second calibration point, and $\overline{y_1}$ and $\overline{y_2}$ are respectively horizontal deviation means under the horizontal distances L1 and L2.

8. The shooting angle fitting method for an integrated precision photoelectric sighting system according to claim 1, wherein the ranging unit comprises a signal transmitting end and a signal receiving end; the view field acquisition unit comprises an optical image acquisition end; the signal transmitting end, the signal receiving end and the optical image acquisition end are all arranged at the front end of the shell, and the display unit is arranged at the rear end of the shell; and a protection unit is arranged at the front end of the shell and buckled on the front end of the shell.

9. The shooting angle fitting method for an integrated precision photoelectric sighting system according to claim 8, wherein the sighting circuit unit comprises an interface board and a core board; a view field driving circuit of the view field acquisition unit, a ranging control circuit in the ranging unit, a key control circuit of a key unit and a battery control circuit of a battery pack are all connected to the core board via the interface board; a display driving circuit of the display unit is connected to the core board;

a memory card can be inserted into the core board; a bullet information database, a gun shooting parameter table and a shooting angle fitting algorithm are set in the memory card; a user can call the gun shooting parameter table according to the used gun to acquire corresponding gun parameter information, call the bullet information database according to the used bullet to acquire corresponding bullet parameter information, and realize precise positioning of the photoelectric sighting system by adopting the shooting angle fitting method.

10. The shooting angle fitting method for an integrated precision photoelectric sighting system according to claim 1, wherein the photoelectric sighting system further comprises two view field adjusting units, one view field adjusting unit is arranged on the display unit, while the other view field adjusting unit is arranged on the shell; the display unit also displays shooting assisting information and working indication information, and the category and the arrangement mode of the information can be set according to the requirements of users.

* * * * *